United States Patent [19]

Ladd, Jr.

[11] Patent Number: 4,626,119

[45] Date of Patent: Dec. 2, 1986

[54] COSMETIC POWDER DISPENSER AND APPLICATOR

[75] Inventor: James E. Ladd, Jr., Rowayton, Conn.

[73] Assignee: Laura Lupton, Inc., Rowayton, Conn.

[21] Appl. No.: 752,133

[22] Filed: Jul. 5, 1985

[51] Int. Cl.[4] ..... A46B 11/00; A46B 11/04

[52] U.S. Cl. ..... 401/123; 132/82 R; 132/82 G; 401/125; 401/281

[58] Field of Search ..... 401/192, 281, 123, 124, 401/135, 125, 82, 191; 132/82 R, 82 G, 81

[56] References Cited

U.S. PATENT DOCUMENTS

| | | | |
|---|---|---|---|
| 1,054,229 | 2/1913 | Methuen | 132/81 X |
| 1,172,293 | 2/1916 | Kohlhepp | 132/82 G |
| 1,274,697 | 8/1918 | Dynowsky | 401/123 X |
| 1,401,508 | 12/1921 | D'Alessandro . | |
| 1,588,633 | 6/1926 | Taylor | 401/123 X |
| 1,690,022 | 4/1928 | Langhaus . | |
| 2,480,331 | 8/1949 | Lecker | 401/125 |
| 3,061,868 | 11/1962 | Miller | 401/135 |

*Primary Examiner*—Steven A. Bratlie

[57] ABSTRACT

A first elongated hollow member has first and second opposite ends, the first end being open, the second end being closed and having a plurality of small spaced apart openings therein. A hollow elongated capsule adapted to be filled with cosmetic powder is closed at one end and open at the other. The capsule is removably slidable into and out of the first member. The capsule, when inserted in the first member, has its open end adjacent the second end of the first member and its closed end closing the first end of the first member. A second elongated hollow member has a first end with a like plurality of like openings and a second open end, the second member rotatably engaging the first member with the first end of the second member adjacent the second end of the first member. The first and second members have a first position of relative rotation at which the openings in the two members are aligned and a second position of relative rotation at which the openings in the two members are out of alignment. A third elongated hollow member has an open end detachably engaging the second end of the second member and has an opposite closed end. A brush has a plurality of essentially parallel bristles with powder applying tips. The brush is disposed in the third member with the tips adjacent the second member. The brush and the third member have manually operated cooperating elements for establishing a first forward position at which said bristles will extend almost entirely out of the third member and a second withdrawn position at which said brush is disposed within the third member.

8 Claims, 5 Drawing Figures

COSMETIC POWDER DISPENSER AND APPLICATOR

BACKGROUND OF THE INVENTION

Small portable inexpensive devices used as cosmetic powder dispensers and applicators are well known in the art as disclosed, for example in U.S. Pat. Nos. 1,401,508 and 1,690,022. These known devices utilize a brush secured to a handle in which a supply of cosmetic powder is disposed. Various types of manually operated valves in the handle enable the user to cause a powder charge to pass or flow through the body of the brush and the bristles onto the tips of the bristles whereby the user can than use the powder charged brush to apply the powder as desired. However, brushes that are so charged contain powder in the body of the brush and on the main portions of the bristles as well as the tips. Since the user only uses the bristle tips when applying the powder, the other powder carrying elements are not needed and indeed often cause powder to be applied in undesired areas and in undesired thickness. Moreover, powder is wasted.

The present invention is directed toward a new type of cosmetic powder dispenser and applicator which retains the portability and inexpensive characteristics of the known devices but at the same time enables the user to charge the tips of the brush bristles with powder without causing any powder to be collected on the body of the brush or upon the main portions of the bristles. The user can then apply the powder to desired area with a high degree of precision and can control the thickness in similar manner.

SUMMARY OF THE INVENTION

A cosmetic powder dispenser and applicator in accordance with the principles of the invention employs a first elongated hollow member having first and second opposite ends. The first end is open. The second end is closed and has a plurality of small spaced apart openings therein. An elongated capsule adapted to be filled with cosmetic powder is closed at one end and open at the other. The capsule is removably slidable into and out of said first member. The capsule, when inserted in the first member, has its open end adjacent the second end of the first member and its closed end closing the first end of the first member. A second hollow elongated member has a first end with a like plurality of like openings and a second open end, the second member rotatably engaging the first member with the first end of the second member adjacent the second end of the first member. The first and second members have a first position of relative rotation at which the openings in the two members are aligned and a second position of relative rotation at which the openings in the two members are out of alignment. A third elongated hollow member has an open end detachably engaging the second end of the second member and has an opposite closed end. A brush has a plurality of essentially parallel bristles with powder applying tips. The brush is disposed in the third member with said tips adjacent the second member. The brush and said third member have manually operated cooperating elements for establishing a first forward position at which said bristles will extend almost entirely out of the third member and a second withdrawn position at which said brush is disposed within the third member.

In use, the dispenser and applicator is disposed vertically with the first member disposed above the second member and the brush is disposed within the third member. The first and second members are then placed into the first position of relative rotation whereby, when powder is in the capsule, the powder flows downwardly through the aligned holes onto the tips of the bristles. When sufficient powder has been applied to the tips, the two members are placed into the second position of relative rotation whereby the flow of powder ceases. The third member is then detached from the second member and the brush is moved into the forward position with respect to the third member. By using the third member as a handle, the user can apply the powder as needed.

It will be apparent that, in this manner, only the tips of the bristles are charged with powder, permitting a more accurate control of the position and thickness of the powder application and avoiding mess and lack of control otherwise caused when powder is carried through the body of the brush before reaching the tips of the bristles.

DETAILED DESCRIPTION OF PREFERRED EMBODIMENTS

Figures 1, 2, 3, 4, 5:
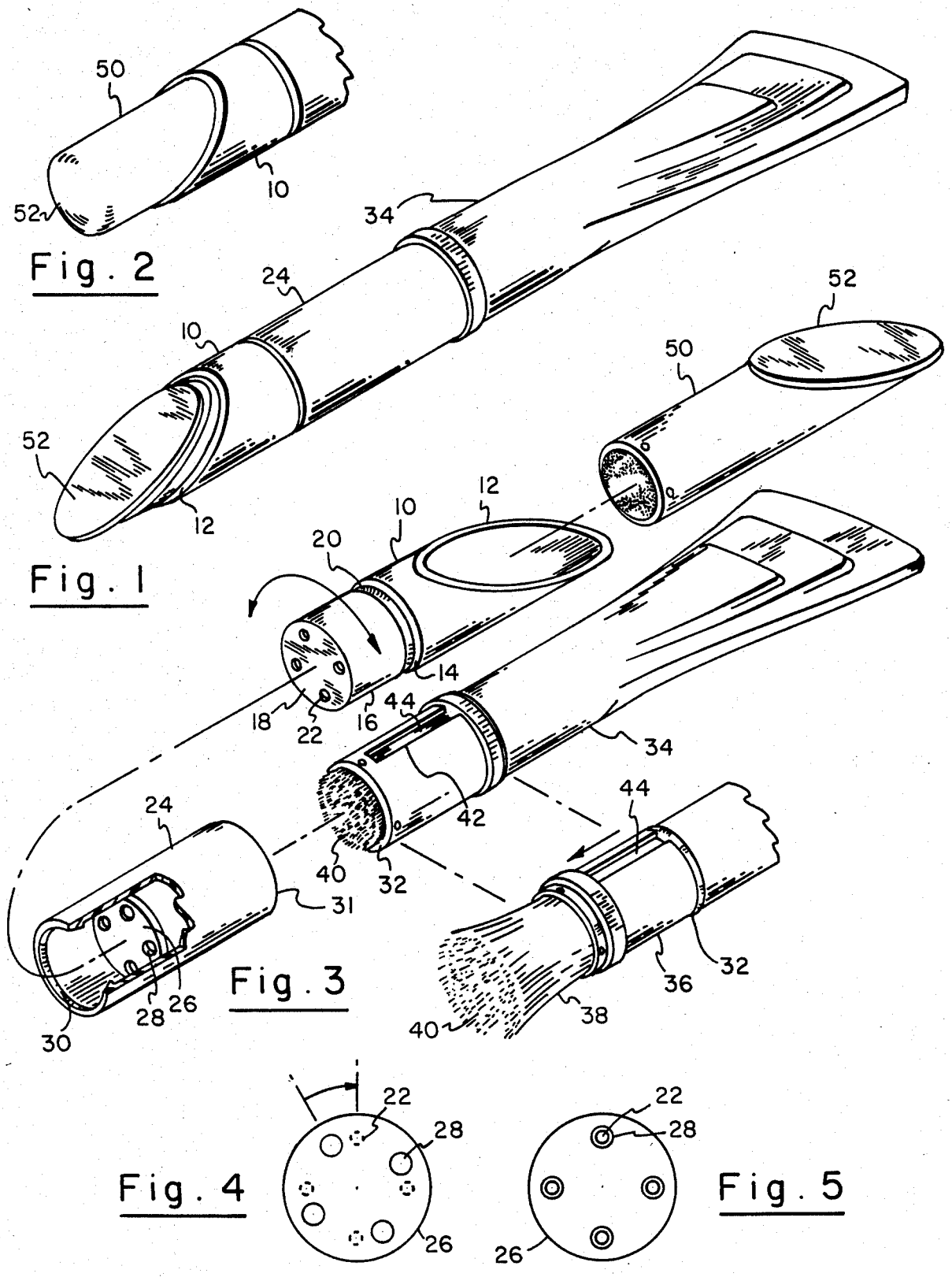
FIG. 1 is a perspective view of one embodiment of the invention.
FIG. 2 is a detail perspective view of a modification of the embodiment shown in FIG. 1.
FIG. 3 is an exploded view of the structure shown in FIG. 1.
FIG. 4 is a detail view of the openings in different parts of the embodiment of FIG. 1 as shown in out of alignment position.
FIG. 5 is a view similar to FIG. 4 but showing the openings in aligned position.

Referring first to FIGS. 1 and 3–5, a first elongated hollow cylindrical plastic member 10 has one open end 12 which lies in a plane disposed at an acute angle with respect to the direction of elongation and has the shape of an ellipse. Member 10 has a shoulder 14 intermediate the ends and an extension of smaller diameter 16 which terminates in the opposite end 18 of this member. End 18 is closed and has a plurality of spaced apart small openings 22 therein. That portion of extension 16 adjacent the shoulder 14 has a circular groove 20 cut therein.

A second elongated hollow cylindrical member 24 has a recessed closed end 26 with a like plurality of openings 28 spaced apart in like manner therein. Member 24 engages extension 16 whereby end 26 abuts end 18. The inner surface of the outer portion of the recessed end carries a lip 30 which rides in the groove 20 so that member 24 is secured to member 10 but is manually rotatable thereabout. These two members have a first position of relative rotation at which each of openings 22 is aligned with a corresponding one of openings 28 (FIG. 5) and a second position at which each of openings 22 is out of alignment with a corresponding opening 28 (FIG. 4). Suitable markings on the outer surfaces of the two members placed adjacent the abutting ends or other conventional means enables the user to place these members in either desired position. The opposite end 31 of member 24 is open.

A third hollow elongated plastic member 34 has one open end 32 and an opposite closed end. End 32 can be removably inserted into end 31. A brush 36 with essentially parallel bristles 38 having tips 40 is slidably disposed in the open end 32 of member 34. That portion of member 34 adjacent end 32 has two oppositely disposed longitudinally extending slots 42, only one of which is visible in the drawing. The outer surface of the brush has two oppositely disposed elongated runners 44, each runner riding in a corresponding slot 42. The brush can be slid outward from the member 34 to a first forward position at which the bristles extend outwardly from the member and can also be slid inwardly into a second withdrawn position at which only the tips 40 are exposed. The positions of the slots and runners are such that the brush is always secured to member 34 which can act as a brush handle.

A hollow elongated plastic capsule 50 can be filled with cosmetic powder and slidably and removably inserted into member 10 via its open end. The capsule has a closed transparent end 52 which meets the open end of member 10 in flush engagement. The opposite end of the capsule is open and abuts the opposite closed end of member 10. Since end 52 is transparent, the user can determine visually how much powder remains to be used. The structure can then be used as previously described.

As shown in FIG. 2, the closed end of the capsule can extend beyond the open end of member 10 and need not have the same shape as this open end. The open end of course need not be eliptically shaped and need not lie in a plane in the manner previously described. For example, this opening can be circular and lie in a plane at right angles to the direction of elongation.

What is claimed is:

1. A cosmetic powder dispenser and applicator comprising:

a first elongated hollow member having first and second opposite ends, the first end being open, the second end being closed and having a plurality of small spaced apart openings therein;

a hollow elongated capsule adapted to be filled with cosmetic powder, said capsule being closed at one end and open at the other, said capsule being removably slidable into and out of said first member, said capsule, when inserted in the first member, having its open end adjacent the second end of the first member and its closed end closing the first end of the first member;

a second elongated hollow member having a first end with a like plurality of like openings and a second open end, the second member rotatably engaging the first member with the first end of the second member adjacent the second end of the first member, the first and second members having a first position of relative rotation at which the openings in the two members are aligned and a second position of relative rotation at which the openings in the two members are out of alignment;

a third elongated hollow member having an open end detachably engaging the second end of the second member and having an opposite closed end; and a brush having a plurality of essentially parallel bristles with powder applying tips, said brush being disposed in the third member with said tips adjacent said second member, said brush and said third member having manually operated cooperating means for establishing a first forward position at which said bristles will extend almost entirely out of the third member and a second withdrawn position at which said brush is disposed within the third member.

2. The dispenser and applicator of claim 1 wherein said capsule is filled with said powder and when the dispenser is disposed vertically with the first member disposed above the second member and the first and second members are in the first rotational position and the brush is in the second withdrawn position, the powder will flow downward out of the capsule and onto said tips, the powder flow being blocked when the first and second members are in the second rotational position.

3. The dispenser and applicator of claim 2 wherein when the third member with the brush in the second withdrawn position is disconnected from the second member and thereafter the brush is moved into the first forward position, the brush can be used to apply the powder as desired by the user.

4. The dispenser and applicator of claim 2 wherein the closed end of the capsule is transparent to permit the user to see how much powder is left in the capsule.

5. The dispenser and applicator of claim 1 wherein the first and second members are secured to each other but can be rotated manually with respect to each other.

6. The dispenser and applicator of claim 1 wherein said means includes two oppositely disposed longitudinally disposed slots in the brush and two oppositely disposed slot engaging runners in the third member.

7. The dispenser and applicator of claim 6 wherein said slots and runners are so disposed and that the brush is secured nondetachably to the third member.

8. The dispenser and applicator of claim 1 wherein the third member forms a brush handle.

* * * * *